United States Patent [19]

Lee

[11] Patent Number: 4,475,247

[45] Date of Patent: Oct. 9, 1984

[54] COMBINATION GUN CASE AND PROTECTIVE APPAREL

[76] Inventor: Robert M. Lee, c/o Hunting World 16 E. 53rd St., New York, N.Y. 10022

[21] Appl. No.: 388,348

[22] Filed: Jun. 14, 1982

[51] Int. Cl.³ ..... F41H 1/02

[52] U.S. Cl. ..... 2/2.5; 2/48; 2/51; 2/94; 206/317

[58] Field of Search ..... 2/2.5, 48, 51, 94; 206/317; 150/52 R

[56] References Cited

U.S. PATENT DOCUMENTS 2,542,667 2/1951 Hanson ..... 206/317

3,783,449 1/1974 Davis ..... 2/2.5

3,973,275 8/1976 Blauer ..... 2/2.5

FOREIGN PATENT DOCUMENTS 961813 1/1975 Canada ..... 206/317

*Primary Examiner*—Louis Rimrodt

*Attorney, Agent, or Firm*—Angelo Notaro

[57] ABSTRACT

The invention is directed to an improved gun case which includes a bullet resistant material, integrally formed as part of the gun case or as an insert within the gun case, so that the gun case may be converted into a lightweight shield or a personal body protector garment.

16 Claims, 6 Drawing Figures

COMBINATION GUN CASE AND PROTECTIVE APPAREL

BACKGROUND OF THE INVENTION

This invention relates to a gun case, and more particularly, to a gun case having means for acting as a lightweight bullet resistant body garment and which is suitable for carrying light infantry weapons such as rifles, carbines, assault rifles, light machine guns, submachine guns, shotguns, machine pistols, grenade launchers and the like.

Today, the semi-automatic or automatic rifle, a long-time standard military issue weapon, has become a necessary weapon in the arsenal of law enforcement personnel in connection with anti-terrorist activities and riot containment. In addition, the higher fire power of a light infantry weapon may be employed by law enforcement personnel in respect to other dangerous situations that arise from time to time. Such weapons are generally not used in every day activities. Some weapons may be issued on a daily basis so as to be on hand when an emergency occurs. Other weapons may be maintained at a central location in a combat ready condition. In either case, it is desirable to store the weapon in a gun case in order to provide protection from dirt and corrosion. In addition, it is preferable to pad the gun case in order to protect the weapon from rough handling.

The typical situation in which an anti-terrorist or riot weapon is employed represents a high amount of risk of personal injury to the law enforcement agent. Accordingly, a so-called bulletproof vest may be issued in conjunction with the weapon. Various vest and jackets are known in the art.

Military personnel are often similarly provided with so-called light infantry weapons including rifles, carbines, assault rifles, shotguns, light machine guns, submachine guns, machine pistols, grenade launchers and the like. In combat situations, military personnel are likewise afforded personal protection through the wear of flak jackets.

With the issuance of separate encased weapons and vest or jackets, there is a risk that the vest or jacket may be left behind in the confusion and rapid deployment that often surrounds unexpected hostile activity. Moreover, it may be inconvenient and dangerous for law enforcement agents or military personnel to have to carry a gun case and a separate vest or jacket since this precludes the holding of other equipment or otherwise limits mobility.

SUMMARY OF THE INVENTION

The invention relates to an improved gun case which also serves as a lightweight bullet-resistant, protective body garment or shield.

In accordance with the invention, the gun case is made of a flexible padded material. The case includes a waterproof outer shell and an inner linear.

In a first embodiment, the inner linear is detachable or detachable in part from the outer shell. Hence, the inner linear is removably held to the inside of the shell by interlocking strips, a separating zipper, or other means such as buttons, snap fasteners and the like. The inner liner is backed with a cushion of polyurethane foam, synthetic pile, sheepskin or other types of padding. The cushion may be permanently attached to the inner liner or loosely located behind the liner. A removable insert, composed of multiple layers of a bullet-resistant fabric such as Kevlar, is fitted between the outer shell and the removable inner liner. Means are provided for fixing the insert in a precise location between the inner liner and outer shell.

In a second embodiment, the bullet-resistant material is integrally formed with the inner liner to take the place of the cushioning material.

The gun case, per se, may be expeditiously opened and the entire case utilized as a bullet resistant body garment.

A carrying strap may be provided with the gun case to be utilized as a sling for carrying the gun case and also as a belt and harness for suspending the gun case or the insert from the body of a user to provide protection against bullets, shot and other projectiles.

The various features of novelty which characterize the invention are pointed out with particularity in the claims annexed to and forming a party of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of the specification, and in which reference numerals shown in the drawing designate like or corresponding parts throughout the same.

DETAILED DESCRIPTION

Figure 1:
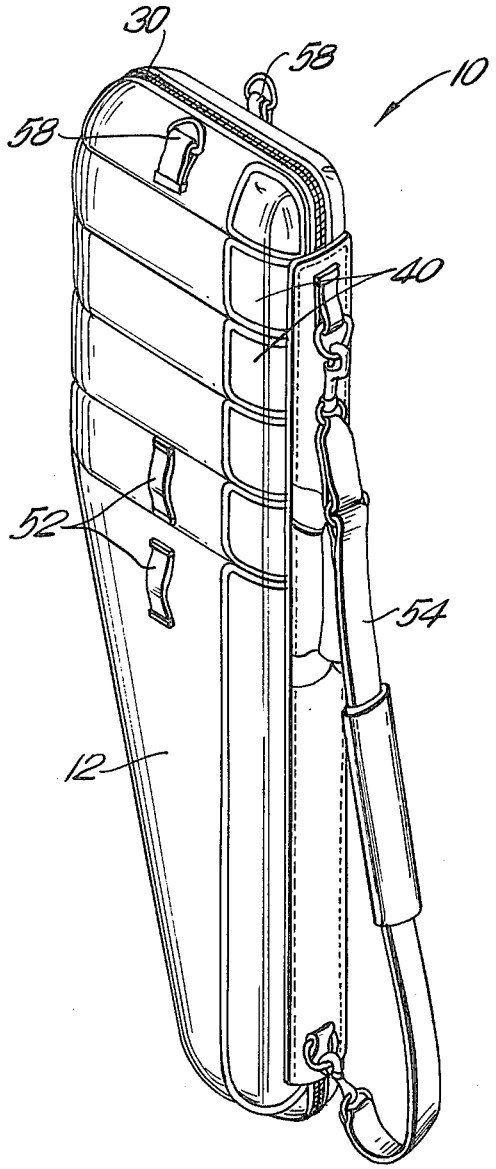
FIG. 1 is a perspective view illustrating a gun case embodying the invention.

Referring now to the drawings, there is shown an elongated gun case 10. The gun case includes an outer shell 12 and an inner liner 14. The outer shell 12 and inner liner 14 are interconnected by means of opposed, continuous or interrupted sections of VELCRO interlocking strips 16 which interconnect at least one of the side margins 18 of the outer shell 12 with at least one of the side margins 20 of the inner liner 14 on the inside surface of the flexible outer shell and, as well, respectively connect the top margin 22 and bottom margin of the outer shell with the corresponding top margin 24 and bottom margin of the inner liner 14.

In accordance with a first embodiment of the invention, the inner liner 14 is totally separable from the outer shell 12. The inner liner 14 can be designed to be only partially separable by permanently affixing one overlapping pair of the side edges of the inner liner 14 to the outer shell 12.

The inner liner 14 can include a cushioned backing made of conventional materials such as polyurethane foam, synthetic pile, sheepskin or other type of padding.

The gun case 10 is formed with means, such as a zipper 30, having mating portions 32, 34 mounted along the periphery of the outer shell 12.

Both the outer shell 12 and inner liner 14 are made of flexible materials so as to permit the gun case to be folded in half and closed along the periphery of the outer shell 12 by the zipper 30. In the folded state, the facing sections of the inner liner 14 are spaced from each other so as to form an inner compartment for housing a light infantry weapon such as a rifle or the like.

As shown in FIG. 1, the gun case may have a conventional shape, and may be designed with outside accessory pockets 40 for additional magazines, cartridge boxes, cleaning equipment, and accessory weapons such as handguns, knives or bayonets.

Figure 2:
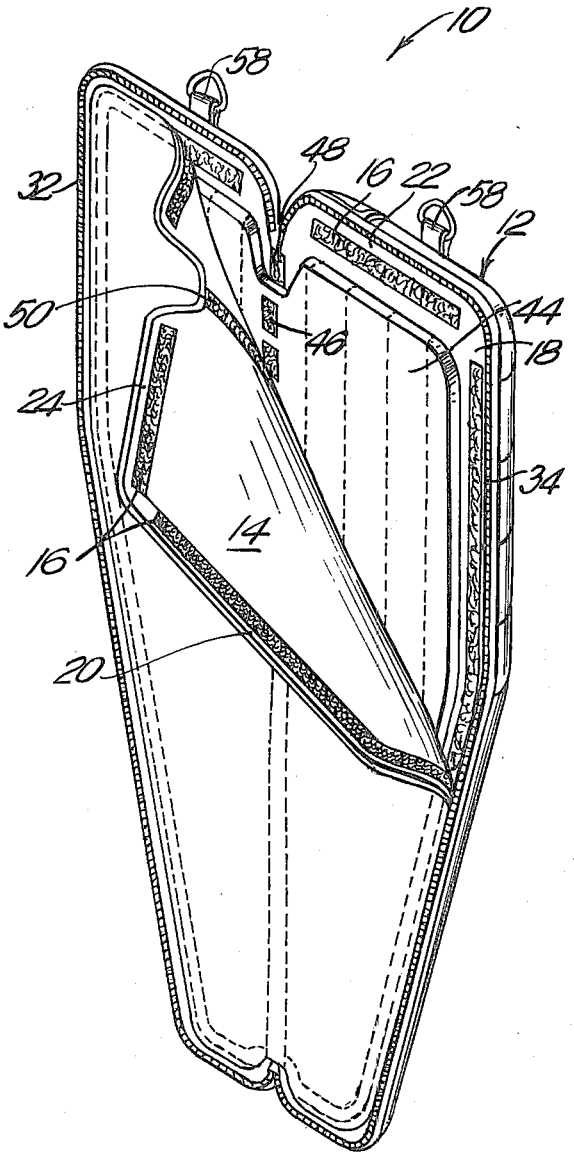
FIG. 2 is a perspective view of the gun case of FIG. 1, in the open position, illustrating an embodiment of the invention in which an inner liner is detachably mounted to the outer shell of the gun case.

An illustrated in FIG. 2, a removable insert 44 of multiple layers of a bullet resistant fabric such as Kevlar is fitted between the outer shell 10 and the removable inner liner 12. The removable insert 44 may preferably have a strip 46 of VELCRO, on opposite sides, running along its central axis (spine), or its edges, or both. One strip 46 interlocks with a mating strip 48 on the inside of the outer shell 12 and the other strip mates with a mating strip 50 on the under side of the removable or partially removable liner 14. The strip 46 can, however, be omitted so that the insert 44 is merely loosely positioned intermediate the inner liner 12 and outer shell 10. Alternately, the insert can be immovably fixed by sewing or other means to either the inner liner 12 or outer shell 10 or both.

Two or more bullet resistant inserts can be provided between the inner liner 12 and outer shell 10. In such case, it will be possible to issue multiple protective garments to personnel at an emergency location, that is, to the person controlling the weapon originally carried in the case as well as to other personnel. Wearing of the gun case, per se, with the plural number of inserts will provide personal protection from higher powered weapons.

Figure 4:
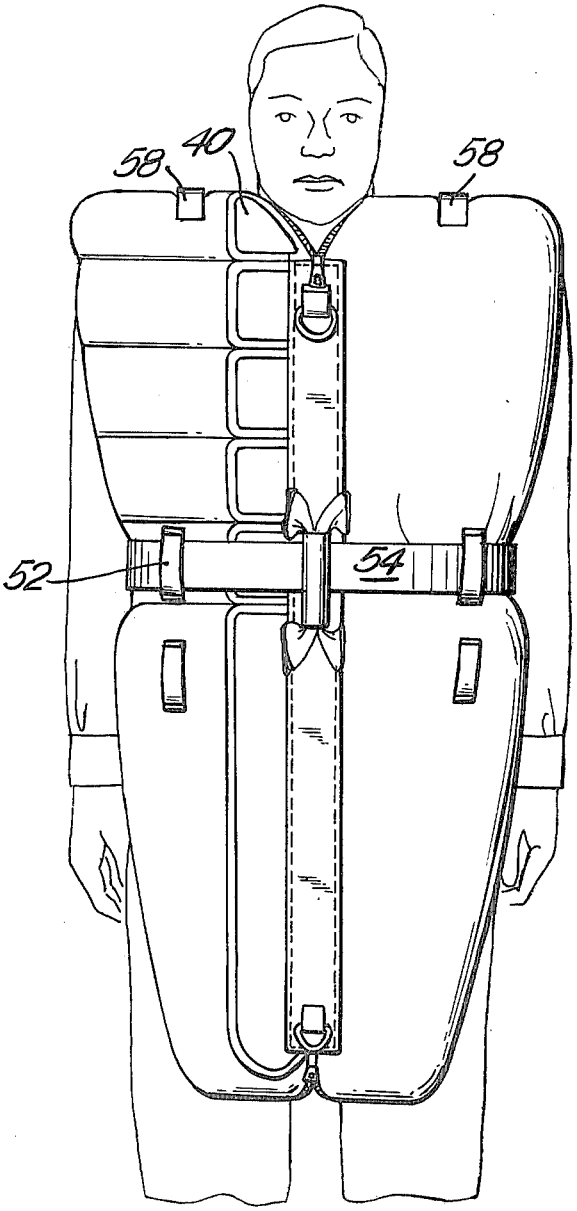
FIG. 4 is a schematic illustration of the use of the gun case of FIG. 1, per se, for personal protection.

The bullet resistant layers of Kevlar material may be integrally formed as part of the inner liner 14 or outer shell 12, or both. It will be recognized by those skilled in the art, in such case, the inner liner 14 need not be removable. The gun case, per se, may be fixed to the body of a user by means of a harness and belt fittings to provide protection against frontal assault by bullets, shot and projectiles as shown in FIG. 4.

It is preferred that the outer shell 12 be coated or otherwise integrally formed with a water resistant material such as nylon coated with polyurethane or neoprene. Bullet resistant inserts of a removable nature should also be so coated in order to provide protection from wetness and soaking in a rainstorm, in a river crossing, or in similar situations. Otherwise, water can seep into the interstices of the bullet resistant material, acting as a lubricant and spreading the fibers thereof, so that a bullet can pass therethrough. Therefore, the removable inserts 44 are preferably covered with a fixed or removal water-resistant cover.

In each case, the degree of protection afforded is governed by the number of layers of bullet resistant material used to construct the removable insert 44 or formed as part of the inner liner 14 or outer shell 12, or both.

Figure 3:
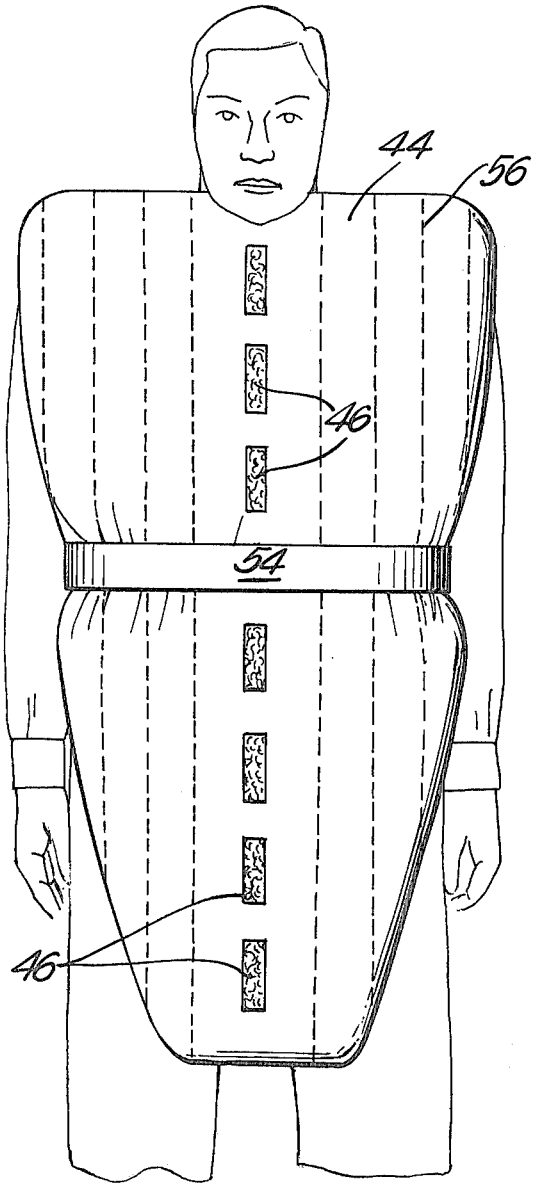
FIG. 3 is a schematic illustration of the use of a bullet resistant insert containable in the gun case of FIG. 1.

As shown in the drawings, the gun case 10 is provided with a sling 54 which may be utilized to both facilitate the carrying of the gun case, and in combination with loop fittings 52, or the like, may be used to suspend and belt the gun case to the body of a user. Alternately, the sling may be utilized to fix the removable insert 44 to the body of a user as shown in FIG. 3. A shoulder strap, harness arrangement or other support could also be attached to loop fittings 58 at the upper end of the gun case for supporting the case about the neck of a user. The stitching need not be parallel or vertically arranged as shown. The insert may be formed of a continuous sheet of anti-ballistic material, or layers of such sheets.

The insert 44 is formed into a continuous flexible pad of anti-ballistic material laminated together by sewing layers by parallel stitching 56 spaced, as shown, in parallel lines, or by other means.

The area protection provided by the case containing an integrally inserted bullet resistant pad or an insert alone will cover the user from the neck to mid-thigh region i.e., the full torso of a wearer, as shown in FIGS. 3 and 4, in the case of a typical submachine gun size case or a case large enough to carry an M-16 automatic rifle with a collapsible stock. Cases for standard rifles will protect the average user from the neck to the knee and over the full width of his body.

Figure 5:
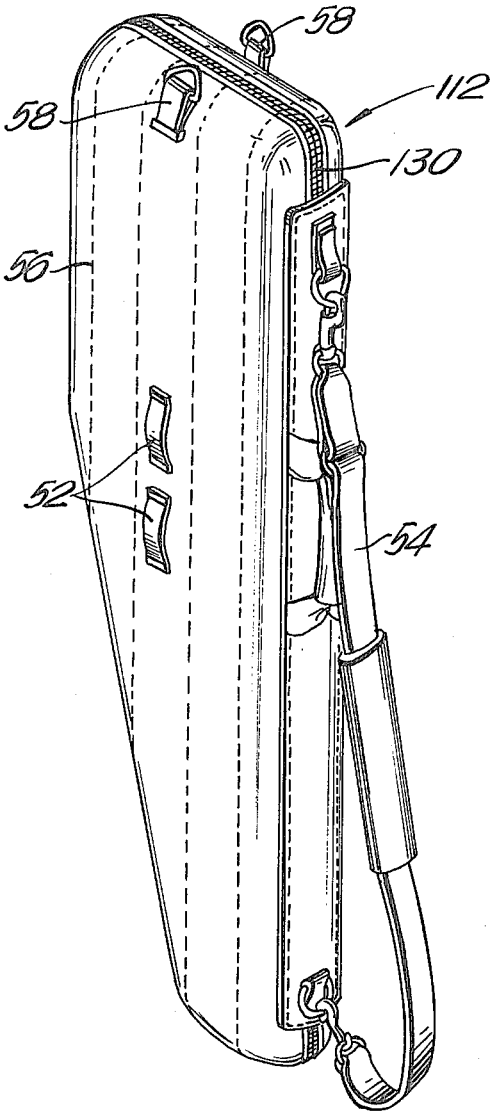
FIG. 5 is a perspective view of a gun case which is composed of a bullet resistant material.
Figure 6:
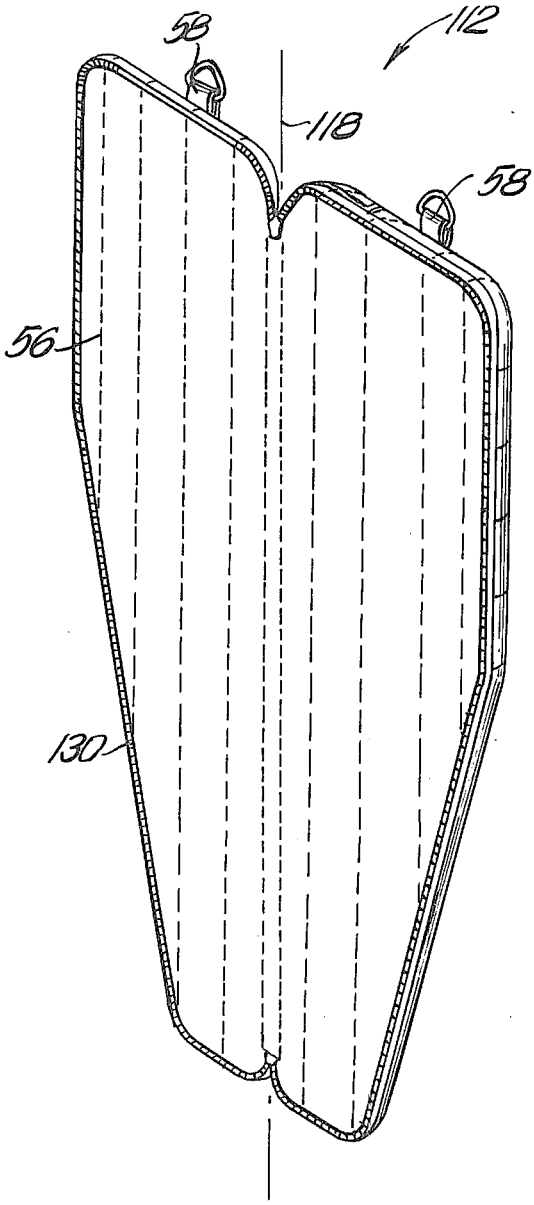
FIG. 6 is a perspective view of the gun case of FIG. 5 in the open position.

As shown in FIGS. 5 and 6, the combination gun case and protective apparel comprises an elongated shell 112 which, per se, is composed of a bullet resistant material. The combination is foldable along a central longitudinal axis 118 to form an inner compartment for housing a gun. Means such as a zipper 130, or other means as described in connection with FIG. 1, are provided for opening and closing the shell 112.

In many cases, the bullet resistant component also serves as the protective padding for the gun.

It will be recognized by those skilled in the art that the case can be built to accommodate two bullet resistant inserts at the same time so that when the bullet resistant insert is removed, the case will continue to have sufficient padding to protect the weapon. In such case, the secondary insert can be permanently fixed to the inside of the removable liner or to the inside of the outer shell, or both, or may also be totally removable. A plurality of cases with liners can be designed to be attached to each other in order to provide protection over doors, windows, small tents and the like.

It will be evident to those skilled in the art that changes may be made without departing from the spirit of the invention claimed. For instance, the outer shell, in a preferred embodiment, is composed of a flexible material, for example, a fabric provided with a coating comprising a water resistant surface as heretofore described. Flexible materials may be more readily conformed to the body of a user when held thereto by a strap or other means. However, it is possible to form a combination gun case and apparel having an outer shell of a lightweight rigid material. For example, a composite material of fiber-reinforced plastic resin such as a fibrous glass in an ABS (acrylonitrile, butadiene and styrene) resin, or a metal such as an aluminum alloy can be used. The rigid outer shell can be lined on its inside with an inner liner of a bullet resistant material. One or more central hinges can be provided along the central longitudinal axis of the shell and a lock or similar means can be provided for holding the case in an open position so that it can be conveniently mounted to the body of a wearer by means previously described herein or equivalents thereof.

Thus, in accordance with the invention there is provided a combination gun case and protective apparel comprising an outer shell 12, a padded inner liner 14 attached to an inside surface of the flexible outer shell 12. Releasable means, mounted along the periphery of the flexible outer shell 12, such as a zipper 30 are provided for securing the outer shell 12 and the inner liner 14 in a folded position to define a compartment for a gun to be carried therein. The compartment may contain additional paraphenilla such as a side arm. Bullet resistant means, such as insert 44, are mounted to at least one of the outer shell 12 and the inner liner 14. Means, such as a sling 54 and loop fittings 52, are provided for securing the bullet resistant means to the body of a wearer.

I claim:

1. A combination gun case and protective apparel comprising an outer shell, an inner liner attached to the inside surface of the outer shell, releasable means, mounted along the periphery of the outer shell, for securing the outer shell and the liner in a folded position to define a compartment for housing a gun; bullet resistant means composed of an anti-ballistic material mounted to at least one of the outer shell and the inner liner; and means for securing bullet resistant means to the body of a wearer so as to provide full torso protection from frontal assault by bullets, shot and projectiles.

2. A combination gun case and protective apparel as set forth in claim 1, wherein said bullet resistant means comprises an insert comprising a Kevlar fabric mounted between the outer shell and the inner liner.

3. A combination gun case and protective apparel as set forth in claim 2, further comprising means for removably fixing the inner liner to the outer shell.

4. A combination gun case and protective apparel as set forth in claim 2, further comprising interlocking strips mounted on opposite sides of the insert and on the sides of the outer shell and the inner liner facing the insert so as to provide means for reproducibly fixing the insert within the gun case in a fixed position.

5. A combination gun case and protective apparel as set forth in claim 1, wherein the bullet resistant means comprising a padding.

6. A combination gun case and protective apparel as set forth in claims 2 or 5, wherein the securing means comprises a sling releasably mounted to the outer shell.

7. A combination gun case and protective apparel as set forth in claim 1, wherein the releasable means comprises a zipper.

8. A combination gun case and protective apparel as set forth in claim 1, wherein the outer shell is composed of a flexible material.

9. A combination gun case and protective apparel as set forth in claim 1 wherein said securing means comprises means for securing said at least one of the outer shell and inner liner which includes the bullet resistant means to the body of the wearer.

10. A combination gun case and protective apparel comprising an outer shell, an inner liner attached to the outer shell, for securing the outer shell and the inner liner in a folded position to define a compartment for housing a gun; bullet resistant means composed of an anti-ballistic material positioned intermediate the outer shell and the inner liner; and means for securing the bullet resistant means to the body of a wearer so as to provide full torso protection from frontal assult by bullets, shot and projectiles.

11. A combination gun case and protective apparel as set forth in claim 9, wherein the bullet resistant means comprises an insert loosely disposed between the inner liner and the outer shell.

12. A combination gun case and protective apparel as set forth in claim 9, wherein the bullet resistant means comprises an insert attached to the outer shell.

13. A combination gun case and protective apparel as set forth in claim 9, wherein the bullet resistant means comprises an insert attached to the inner liner.

14. A combination gun case and protective apparel as set forth in claim 9, wherein the bullet resistant means comprises an insert attached to both the inner liner and the outer shell.

15. A combination gun case and protective apparel as set forth in claim 10 or 11 or 12 or 13, further comprising a second insert of a bullet resistant material positioned intermediate the inner liner and the outer shell.

16. A combination gun case and protective apparel as set forth in claim 9 wherein said securing means comprises means for securing said at least one of the outer shell and inner liner which includes the bullet resistant means to the body of the wearer.

* * * * *